US006066013A

United States Patent [19]

Kawamura et al.

[11] Patent Number: 6,066,013

[45] Date of Patent: May 23, 2000

[54] DRAIN STRUCTURE OF AN OUTBOARD MOTOR

[75] Inventors: Hiroshi Kawamura; Kouichi Oka, both of Wako, Japan

[73] Assignee: Honda Giken Kogyo Kabushiki Kaisha, Japan

[21] Appl. No.: 09/243,096

[22] Filed: Feb. 2, 1999

[30] Foreign Application Priority Data

Feb. 10, 1998 [JP] Japan ..... 10-028766

[51] Int. Cl.[7] ..... B63H 20/32; F02F 7/00

[52] U.S. Cl. ..... 440/76; 440/77; 123/195 P

[58] Field of Search ..... 440/88, 76, 77, 440/78, 900; 114/198; 123/195 C, 195 P, 198 E

[56] References Cited

U.S. PATENT DOCUMENTS 4,533,331 8/1985 Bland ..... 440/88
4,698,037 10/1987 Watanabe et al. ..... 440/78
4,758,190 7/1988 Van Vuren ..... 440/88
4,776,820 10/1988 Mapes ..... 440/88

*Primary Examiner*—S. Joseph Morano
*Assistant Examiner*—Patrick Craig Muldoon
*Attorney, Agent, or Firm*—Skjerven, Morrill, MacPherson, Franklin & Friel LLP; Alan H. MacPherson

[57] ABSTRACT

In an outboard motor, a simple drain structure is provided which can drain the water that has entered the engine compartment while effectively preventing water from entering the engine compartment through the drain structure itself. A drain passage is formed in a peripheral portion of an engine mount member which, together with a part of an engine cover, constitutes a bottom of the engine compartment. A reed valve unit made of a resilient material and having a base portion and a valve portion is fittingly received by the side wall defining the drain passage of the mount member so that the valve portion normally closes the opening of the drain passage due to its own resiliency and bend to drain water when water accumulates in the drain passage.

4 Claims, 3 Drawing Sheets

DRAIN STRUCTURE OF AN OUTBOARD MOTOR

TECHNICAL FIELD

The present invention relates to an outboard motor, and more particularly to a drain structure provided in a lower portion of an engine cover of an outboard motor for draining water from the engine compartment.

BACKGROUND OF THE INVENTION

An outboard motor powered by an internal combustion engine is usually mounted directly on a transom at the stern of a boat, and is oftentimes covered with splashes of water during operation of the boat. In order to protect the internal combustion engine from splashes of water, the engine is typically enclosed in an engine cover (See for example U.S. Pat. No. 4,698,037).

The internal combustion engine requires air for combustion, and therefore the engine cover must be provided with an air intake for introducing air to the engine. This makes it practically impossible to completely prevent ingress of water into the engine compartment.

In order to discharge water from the engine compartment, it has been conventionally known to provide a drain aperture in the bottom plate of the engine compartment. However, such a drain aperture itself may permit ingress of water into the engine compartment for example when the outboard motor is totally or partially submerged during heavy wave conditions. Such ingress of water from the drain aperture can damage electric components mounted in the engine compartment. Although some conventional drain systems are designed so as to prevent water from entering the engine compartment (See for example U.S. Pat. No. 4,758,190), they had complicated configurations and were difficult to assemble.

BRIEF SUMMARY OF THE INVENTION

In view of such problems as above, a primary object of the present invention is to provide an outboard motor comprising a drain structure that can be readily assembled to drain water accumulated in the engine compartment while preventing water from entering the engine compartment through the drain structure.

A second object of the present invention is to provide an outboard motor comprising such a drain structure which is simple and can be made with low manufacturing cost.

According to the present invention, these and other objects can be accomplished by providing an outboard motor comprising: an upper unit comprising an internal combustion engine and an engine cover for covering the engine; a lower unit mounted under the upper unit, the lower unit comprising an extension case for housing a drive shaft which extends vertically to drivingly interconnect the internal combustion engine and a propeller shaft carrying a propeller and a gear case mounted at a lower end of the extension case for rotatably supporting the propeller shaft; a mount member disposed between the upper unit and the lower unit, the mount member extending generally horizontally to mount the engine thereon and sealingly engaged with the engine cover around its periphery so that the engine cover and the mount member jointly define an engine compartment, wherein a drain passage for draining water from the engine compartment is formed in a peripheral portion of the mount member so that the drain passage has an opening facing the engine cover; and a reed valve unit made of a resilient material and attached to the mount member so as to normally close the opening of the drain passage, the reed valve unit comprising a base portion for the attachment of the reed valve unit and a valve portion adapted so that the valve portion is normally urged to close the opening of the drain passage and when water is accumulated in the drain passage the valve portion bends to open the opening of the drain passage to discharge the accumulated water; wherein a side wall defining the drain passage of the mount member is adapted to fittingly receive the base portion of the reed valve unit.

Thus, the reed valve unit can be readily attached to the mount member with its base portion fittingly received by the side wall defining the drain passage of the mount member, and the valve portion of the reed valve unit that normally closes the opening of the drain passage effectively prevents the ingress of water into the engine compartment, while it can bend to drain the water accumulated in the drain passage.

Typically, the base portion of the reed valve unit has a protrusion on its side and the side wall defining the drain passage is provided with a recess complementary to the protrusion.

It will be preferable if the engine cover lies over the reed valve unit so as to pressingly hold the reed valve unit in an assembled state of the outboard motor, and more preferably a sealing member is interposed between the engine cover and the reed valve unit.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
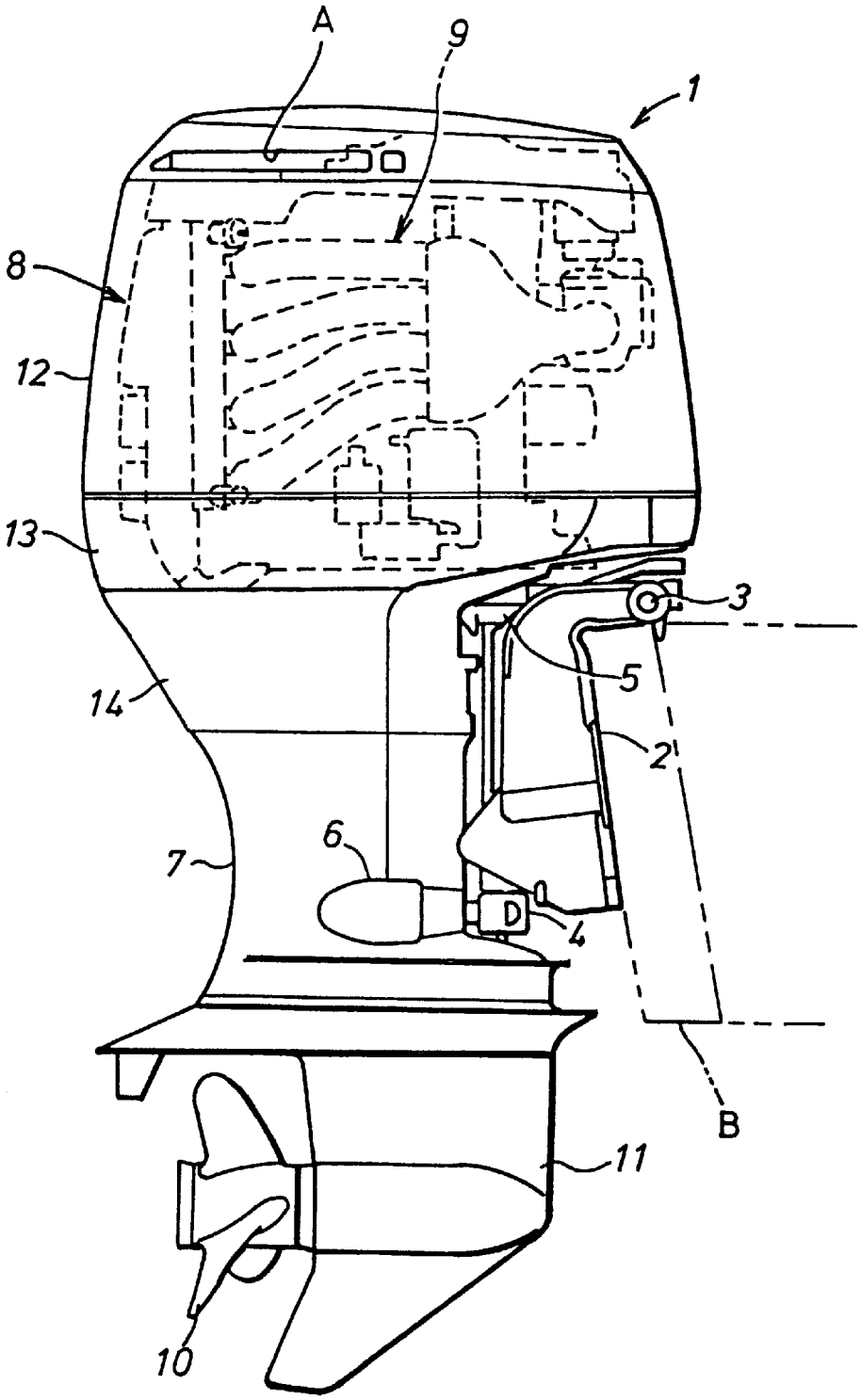
FIG. 1 is a side view of an outboard motor to which the present invention is applied.

FIG. 1 generally shows a side view of an outboard motor 1 which incorporates a drain system according to the present invention. The outboard motor 1 is mounted to a transom B of a boat via a stern bracket 2 equipped with clamping means.

To the stern bracket 2 is connected a swivel case 4 so as to be tiltable around a tilt shaft 3 extending laterally and horizontally with respect to the boat. Upper and lower mount arms 5 and 6 extend rearwardly from the upper and lower ends of the swivel case 4, and support an extension case 7 accommodating a drive shaft so that the extension case 7 can swing laterally around a vertical swivel shaft provided to the swivel case 4.

An internal combustion engine 9 is placed above the extension case 7, and accommodated in an engine compartment 8. A gear case 11 is attached to a lower end of the extension case 7, and rotatably supports a propeller shaft carrying a screw propeller 10.

The engine compartment 8 is primarily defined by an upper engine cover 12 for covering an upper part of the engine 9 and a lower engine cover or an under case 13 for covering a lower part of the engine 9. Further, another cover member or a skirt member 14 is provided so as to cover the joint portion between the under case 13 and the extension case 7, as described more in detail later.

Figure 2:
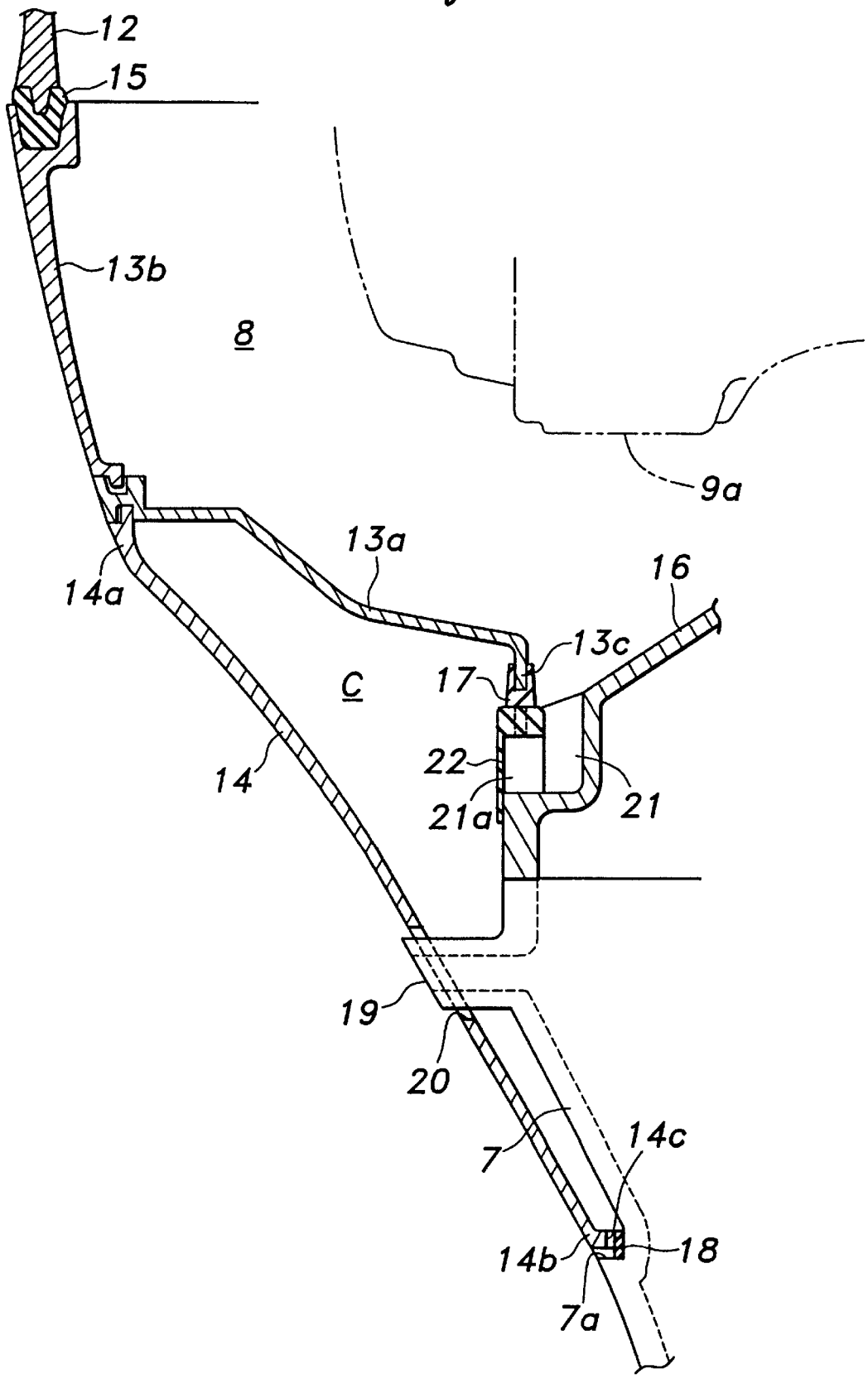
FIG. 2 is an enlarged cross sectional view showing the drain structure according to the present invention.

As shown in FIG. 2, the upper engine cover 12 is attached to the under case 13 via a sealing member 15 made of a rubber or the like, and can be easily detached to expose engine main part 9*a* comprising a cylinder block, cylinder head, head cover, crankcase, etc., for maintenance purpose.

In this embodiment, the under case 13 consists of two separate parts, namely, a bottom wall member 13*a* and a side wall member 13*b* surrounding a lower side of the engine 9. A mount case or mount member 16 adapted to securely mount the engine 9 thereon is fixedly attached by means of a bolt or the like to the upper end of the extension case 7, and the bottom wall member 13*a* is attached to the mount case 16 by means of a bolt or the like (not shown in the drawings).

The bottom wall member 13*a* is provided with a downwardly extending flange portion 13*c* along its inner periphery. The flange portion 13*c* is engaged with an upper surface of the mount case 16 via a sealing member 17 made of rubber or the like. Thus, the bottom wall member 13*a* and the mount case 16 jointly constitute the bottom of the engine compartment 8. An inner space of the extension case 7 under the mount case 16 serves as an exhaust expansion chamber.

The skirt member 14 is held by the under case 13 and the extension case 7 so as to cover a joint between the extension case 7 and the mount case 16 as well as that between the mount case 16 and the bottom wall member 13*a*. In the illustrated embodiment, an upper end 14*a* of the skirt member 14 is connected to an underside of an outer periphery of the bottom wall member 13*a,* with a projection provided to the upper end 14*a* received by a recess formed on the underside of the outer periphery of the bottom wall member 13*a* to thereby achieve a sealing engagement, although other connection structure may be employed in other embodiments.

A lower end 14*b* of the skirt member 14 is engaged with a step portion 7*a* provided on an outer surface of the extension case 7. Thus, a closed space C is defined under the engine compartment 8 by the skirt member 14, bottom wall member 13*a,* mount case 16 and extension case 7. The lower end 14*b* is provided with a notch 14*c* through which water is discharged to outside of the outboard motor 1, as described later. A cushioning member 18 made of rubber or the like is preferably provided between the lower end 14*b* and the step portion 7*a* for damping the vibration of the skirt member 14 during the operation of the outboard motor 1. The skirt member 14 is also provided with an aperture 20 for accommodating a subsidiary exhaust duct 19 provided to the extension case 7.

A drain passage 21 is formed at a joint between the bottom wall member 13*a* and the mount case 16. In the shown embodiment, the drain passage 21 is preferably formed in a periphery of the mount case 16. An opening 21*a* of the drain passage 21 is closed by a reed valve unit 22 formed of a resilient material such as a rubber or the like.

Figure 3:
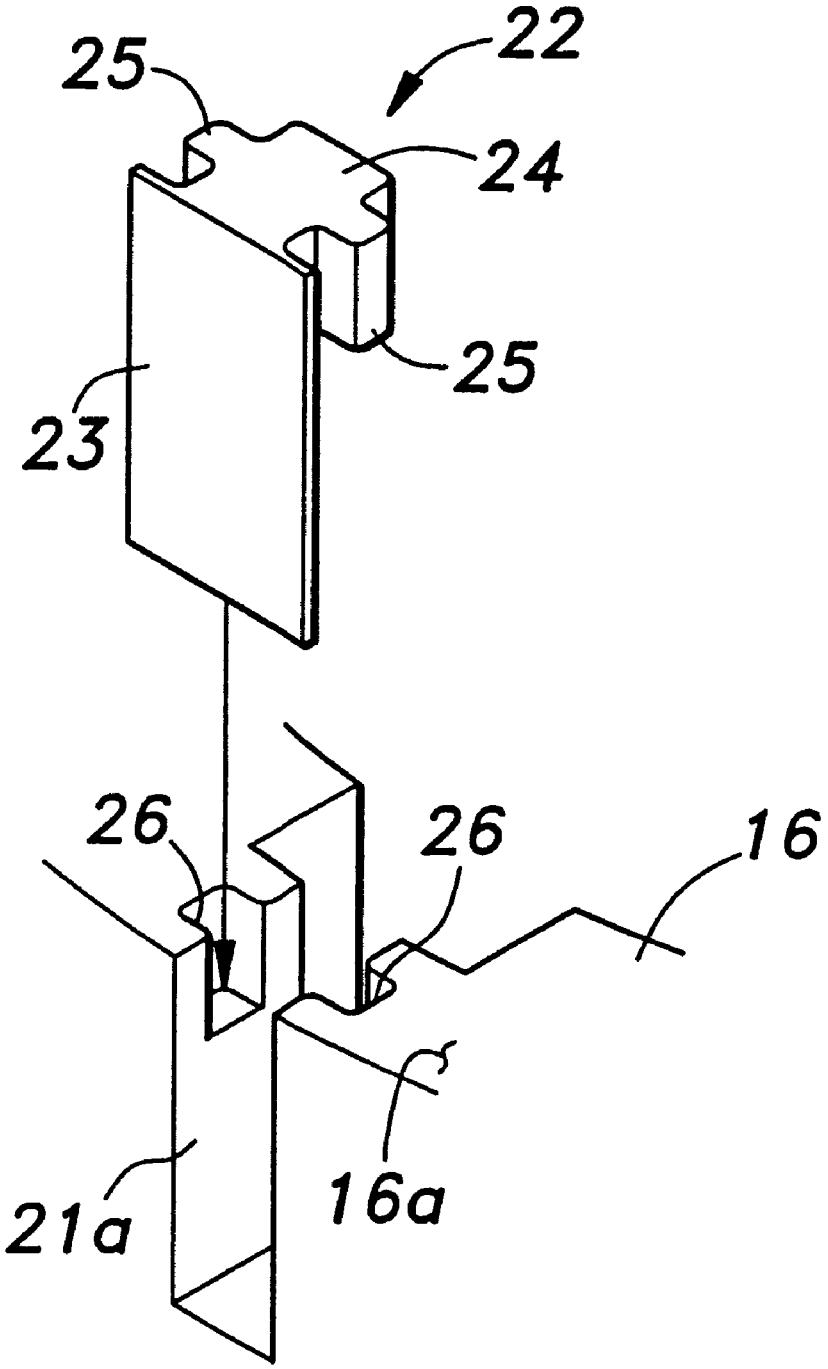
FIG. 3 is a perspective view for showing the relation between the valve unit and the drain aperture according to the present invention.

As shown in FIG. 3, the reed valve unit 22 comprises a valve portion 23 and a base portion 24 for attaching the reed valve unit 22 to the opening of the drain passage 21. The base portion 24 of the reed valve unit 22 is provided with side projections 25, while side walls defining the drain passage 21 of the mount case 16 are provided with complementary recesses 26 adapted to fittingly receive the side projections 25. In the assembled state, the valve portion 23 of the reed valve unit 22 is normally urged to sealingly abut the outer surface of the mount case 16 around the opening 21*a* of the drain passage 21 due to its own resiliency. When, during the engine operation, splashes of water enters the engine compartment 8 through the air intake A, travels downwardly along the inner surface of the under case 13 and/or along the upper surface of the mount case 16, and accumulates in the drain passage 21, the valve portion 23 bends outwardly to drain the accumulated water into the space C. The water drained into the space C is further discharged out of the outboard motor 1 through the notch 14*c* provided to the skirt member 14. Even if water reversely enters the space C through the notch 14*c* or other joint portions, the valve portion 23 of the reed valve unit 22 that normally closes the opening 21*a* of the drain passage 21 effectively prevents the ingress of water into the engine compartment 8.

It should be noted that the reed valve unit 22 can be readily installed by pressing down the side projections 25 into the corresponding side wall recesses 26 of the mount case 16, and can be securely held by the flange portion 13*c* of the bottom wall member 13*a* overlying the reed valve unit 22, as shown in FIG. 2.

As described above, according to the present invention the ingress of water into the engine compartment through the drain passage formed at a lower part of the engine compartment can be prevented effectively and in a very simple fashion, and thus, the present invention is greatly advantageous in improving water protection of the outboard motor.

Although the present invention has been described in terms of preferred embodiments thereof, it is obvious to a person skilled in the art that various alterations and modifications are possible without departing from the scope of the present invention which is set forth in the appended claims. For example, the base portion 24 of the reed valve unit 22 may be provided with side recesses while the side walls of the mount case 16 defining the drain passage 21 may be provided with projections corresponding to the side recesses. Further, it may be possible to form the drain passage at an inner periphery of the bottom wall member 13*a* instead of at an outer periphery of the mount cover 16.

What we claim is:

1. An outboard motor comprising:

an upper unit comprising an internal combustion engine and an engine cover for covering the engine;

a lower unit mounted under the upper unit, the lower unit comprising an extension case for housing a drive shaft which extends vertically to drivingly interconnect the internal combustion engine and a propeller shaft carrying a propeller and a gear case mounted at a lower end of the extension case for rotateably supporting the propeller shaft;

a mount member disposed between the upper unit and the lower unit, the mount member extending generally horizontally to mount the engine thereon and sealingly engaged with the engine cover around its periphery so that the engine cover and the mount member jointly define an engine compartment, wherein a drain passage for draining water from the engine compartment is formed in a peripheral portion of the mount member so that the drain passage has an opening facing the engine cover; and a reed valve unit made of a resilient material and attached to the mount member so as to normally close the opening of the drain passage, the reed valve unit comprising a base portion for the attachment of the reed valve unit and a valve portion adapted so that the valve portion is normally urged to close the opening of the drain passage and when water is accumulated in the drain passage the valve portion bends to open the opening of the drain passage to discharge the accumulated water;

wherein a side wall defining the drain passage of the mount member is adapted to fittingly receive the base portion of the reed valve unit.

2. An outboard motor according to claim 1, wherein the base portion of the reed valve unit has a protrusion on its side and the side wall defining the drain passage is provided with a recess complementary to the protrusion.

3. An outboard motor according to claim 2, wherein the engine cover lies over the reed valve unit so as to pressingly hold the reed valve unit in an assembled state of the outboard motor.

4. An outboard motor according to claim 3, wherein a sealing member is interposed between the engine cover and the reed valve unit.

* * * * *